US006101751A

United States Patent [19]

Hicks

[11] Patent Number: 6,101,751

[45] Date of Patent: Aug. 15, 2000

[54] ADVERTISING SUBDTRATE FLUSH MOUNTABLE TO TRUCKS

[76] Inventor: Charles H. Hicks, 13908 Lake Point Dr., Clearwater, Fla. 34622

[21] Appl. No.: 08/846,602

[22] Filed: Apr. 30, 1997

Related U.S. Application Data

[63] Continuation-in-part of application No. 08/591,055, Jan. 25, 1996, abandoned.

[51] Int. Cl.[7] ..... G09F 21/04

[52] U.S. Cl. ..... 40/590; 40/603; 160/328

[58] Field of Search ..... 40/590, 591, 603, 40/604; 160/328, 387, 388, 392, 395

[56] References Cited

U.S. PATENT DOCUMENTS

| | | | |
|---|---|---|---|
| 4,754,566 | 7/1988 | Gordon | 40/603 |
| 5,058,299 | 10/1991 | Suzuki | 40/590 X |
| 5,349,772 | 9/1994 | Pardue | 40/590 |
| 5,373,653 | 12/1994 | Suzuki | 40/590 X |
| 5,507,109 | 4/1996 | Rinzler | 40/590 X |
| 5,845,423 | 12/1998 | Hick | 40/590 X |

FOREIGN PATENT DOCUMENTS

| | | | |
|---|---|---|---|
| 2636161 | 3/1990 | France | 40/590 |

*Primary Examiner*—Brian K. Green
*Attorney, Agent, or Firm*—Ronald E. Smith

[57] ABSTRACT

A substrate upon which an advertising message may be printed is releasably attachable to the side of a truck in a way that prevents the substrate from flapping when the truck is moving at high speeds. The upper edge of the substrate is retained within a rigid frame mounted in a recess formed in the side wall of the truck, and is quickly insertable into or removable from such rigid frame. The forward edge of the substrate is wrapped around the forward corner of the truck so that wind cannot get under the substrate, and a plurality of front-mounted winches pull the forward edge toward them so that slack is removed from the substrate. The rearward edge of the substrate is wrapped around a rear corner of the truck so that the effective width of the truck is not increased by attachment hardware. Another plurality of winches mounted on the underside of the truck engage straps that hold the lowermost edge of the substrate so that activation of the winches pulls the lowermost edge toward those winches to further remove slack from the substrate. In a two-sided embodiment, a first set of cargo tie down straps and winches are disposed in overlying relation to the front wall of the truck and used to interconnect opposing forward edges of respective substrates, and a second set of cargo tie downs and winches are positioned under the truck and used to interconnect opposing longitudinal edges of respective substrates.

8 Claims, 11 Drawing Sheets

ADVERTISING SUBDTRATE FLUSH MOUNTABLE TO TRUCKS

CROSS REFERENCE TO RELATED APPLICATIONS

This application is a continuation-in-part of U.S. patent application Ser. No. 08/591,055, filed Jan. 25, 1996, now abandoned, by the same inventor.

BACKGROUND OF THE INVENTION

1. Field of the Invention

This invention relates, generally, to an apparatus for removably attaching an advertising sign to the side of a truck or other support surface. More particularly, it relates to a mounting apparatus that, when used with a truck, does not increase the effective width of the truck.

2. Description of the Prior Art

The number of billboards available for use by the outdoor advertising industry is shrinking, for several reasons. Many government entities are ruling that billboards are "nonconforming structures," for example, and providing for amortizing periods. Road rights-of-way are being widened, developers are utilizing roadside land for alternate uses, and so on. Nonetheless, demand for outdoor advertising space remains strong.

What is needed, then, is a new platform for outdoor, i.e., billboard-type advertising.

The side panels of conventional trucks, semitrailers, and other types of trucks (hereinafter referred to collectively as trucks) are approximately the same size as billboards; accordingly, if such space could be put to advantageous use, such side panels could serve as an additional platform for outdoor advertising space.

A few advertisers have tried painting advertising copy and artwork directly onto the side panels of trucks. The copy, typically, includes a company's name, its sloqan, a picture, or the like. Painted advertising copy is acceptable, however, only if the message is substantially permanent; frequent changes of advertising messages through repainting is clearly impractical. Thus, a company whose primary business is not trucking using its own private truck fleet might find it practical to paint the company's name, artwork, and slogan on all trucks of the fleet, but the company will not be able to economically change its advertising copy (e. g., to promote different products) during the various seasons of the year. This restricts the company to unchanging and therefor less effective advertising. Accordingly, painting is seldom used as a means for applying advertising copy to a truck.

A much more common technique includes the truckside application of a pressure-sensitive adhesive substrate upon which an advertising message has been imprinted by electrostatic, screenprint, or other means. Due to the size of the trucksides, these advertising panels are usually prepared in numerous smaller panels which are adhered individually to the truckside as a mosaic (in mosaic fashion).

Alternatively, a single panel or a small number of panels may be used if the message is not designed to cover the entire side of the truck.

It is time-consuming and expensive to install the pressure sensitive adhesive panels. Moreover, it is difficult to remove them if it is desired to change the message. Furthermore, the advertising substrate is destroyed by removal, which limits its use to one application.

What is needed, then, is a means that would enable private truck fleet owners to change their truck-side advertising copy for seasonably-sensitive (Christmas, etc.) product promotions. Specific products or advertising tie-ins with vendors to retail establishments could also be promoted more easily.

Moreover, there are many For Hire Common Carrier truck fleets, i.e., trucks owned by trucking companies or individual owner-operators, that are used to transport goods of many different companies. Therefore, it is not practical to apply advertising signs having any degree of permanency to trucks of this type. Thus, the valuable advertising space on the sides of such trucks is underutilized.

Recent developments in the outdoor advertising (billboard) industry include the use of single piece reinforced vinyl fabric sheets as the substrate upon which an advertising message may be hand painted or otherwise applied. Advances in computer technology, including ink-let and other digital printing systems, have also enabled the application of intricate advertising messages and designs onto such substrate.

However, the industry still has not developed an optimal means for quickly attaching and detaching such substrate to the side panels of trucks.

Several inventors have developed systems for facilitating the temporary attachment of an advertising message to the side of a truck. An earlier construction having some similarity to the present disclosure appears in U.S. Pat. No. 5,373,655 to Suzuki. A poster in the form of a vinyl or fabric sheet is held in position by a structure that includes a sliding track or rail, a frame, a rope, and tensioning means including tension adjusters.

Although the Suzuki and other early changeable copy advertising panels perform their intended functions, they are difficult and time-consuming to install if unskilled labor is used. Some of the earlier designs also detract from the appearance of the truck. For all of these reasons, the earlier designs have not met with substantial acceptance in the marketplace.

Another serious shortcoming of all of the known devices for attaching substrates to trucks is that such devices increase the effective width of the truck to which they are attached. All states and the federal government have maximum width restrictions applicable to all over the road vehicles. Many trucks are manufactured to have the maximum width allowable under such laws. Thus, the addition of any non-safety-related hardware to the side of such a truck results in violation of such laws.

What is needed, then, is a removably mounted advertising substrate for use on a truck and a novel means for quickly and easily installing, adjusting, or removing such substrate that does not require skilled labor. The advertising substrate, once installed, should not flap in the wind, nor should its attachment means detract from the appearance or function of the truck. Most importantly, the hardware for installing the substrate should not cause the overall width of the truck to exceed the leqally allowable width, i.e., it should not increase the effective width of the truck.

Many trucks have a recess formed in their frame along a longitudinally-extending uppermost edge of their side walls. This recess may be used advantageously to harbor hardware that grasps the uppermost end of a substrate so that such hardware does not increase the effective width of the truck. However, no such recess is available along the vertically extending corners at the rearward end of the side walls. Accordingly, any hardware attached to the side of the truck to engage the trailing end of a substrate will necessarily jut out and increase the effective width of the truck. Nor can such hardware be secured to the rear wall of a truck equipped with hingedly-mounted doors, because the hinges interfere with such hardware.

Thus, there is a need for a mounting means that could engage the vertically-extending trailing edge of a substrate without adding to the effective width of a truck. The needed mounting means would also be free from interference by hinges in trucks having hingedly-mounted rear doors.

However, in view of the pertinent art at the time the present invention was made, it was not obvious to those of ordinary skill in such art how the needed apparatus could be provided.

SUMMARY OF THE INVENTION

The longstanding but heretofore unfulfilled need for an apparatus that overcomes the limitations of the prior art is now met by an apparatus that is easily and quickly attachable to or detachable from the side of a truck, which does not flap in the wind at highway speeds, which does not detract from the appearance of the truck, and which does not add to the effective width of the truck. Accordingly, its use on all highways is in conformity with laws relating to maximum allowable vehicle widths.

The novel apparatus attaches a flexible substrate, having a predetermined longitudinal and vertical extent, to a support surface such as a side of a truck. However, it may be used in other applications as well such as outdoor advertising billboards and the like.

In one embodiment, the novel assembly includes a recessed upper attachment means for releasably attaching a longitudinally extending upper edge of the substrate to a longitudinally extending upper edge of the truck without increasing the effective width of the truck, a rearward attachment means mounted on a transversely disposed rear wall of a truck in non-interfering relation to door hinges on such rear wall for releasably attaching a vertically extending rearward edge of the substrate, a forward attachment means for releasably attaching a vertically extending forward edge of the substrate to a transversely disposed front wall of the truck, and a lower attachment means for releasably attaching a longitudinally extending lower edge of the substrate to an underside of the truck.

In connection with trucks having rear doors that are retractable upwardly into the truck, much like a garage door, the vertically extending rearward edge of a substrate may be wrapped around the vertically extending rear corner of a truck and secured to hardware mounted on the rear wall of the truck. Such trucks lack hinged doors and thus no hinges interfere with the hardware for securing the rearward edge of the substrate, and since the hardware is mounted on the rear wall of the truck, the hardware does not increase the width of the truck.

More particularly, the forward attachment means is adapted to releasably attach a vertically extending forward edge of the substrate to a transversely disposed front wall of a truck. The flexible substrate bends around a vertically disposed forward edge of the truck to prevent air from flowing in a space between said substrate and a side of the truck. In a first embodiment, a plurality of winches is mounted to said transverse front wall to tension the substrate as required.

The rearward attachment means employs no winches but engages the vertically-extending rearward edge of the substrate and causes it to wrap around the vertically-extending rearward corner of the truck in much the same manner as the forward end wraps around the front corner of the truck. The rearward attachment means is mounted to the rear wall of the truck so that such attachment means does not add to the effective width of the truck. Significantly, on hinged-door trucks, the rearward attachment means is mounted above, between, and below the hinges in non-interfering relation thereto.

On retractable overhead door trucks, the rearward attachment means includes a continuous, unbroken frame member that extends vertically adjacent the outboard edge of the rear wall so that the trailing end of the substrate which is equaled by said frame member wraps around the vertically extending rear corners of the truck and so that the frame member does not increase the effective width of the truck.

It is a primary object of the invention to provide an advertising platform in the form of a flexible substrate that is quickly and easily attachable to and removable from the sides of a truck.

Another important object is to provide novel attachment means for securing said substrate to a truck in a form that is not subject to flapping when subjected to high speed winds of the type encountered in highway travel.

Another major object is to provide a two part attachment means for engaging the trailing end of a substrate attached to trucks having hinged rear doors. The two part attachment means includes a first part that is left on the truck at all times so that only the substrate and the second part of the attachment means need be removed when an advertising message is changed.

Another object is to provide an attachment means for engaging the trailing end of a substrate attached to trucks of the overhead retractable door type.

Still another major object is to provide an attachment means for both types of trucks (hinged doors and overhead retractable doors) that does not increase the effective width of the truck to which it is attached so that use of such attachment means does not place the truck's owner in violation of vehicle maximum width laws.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
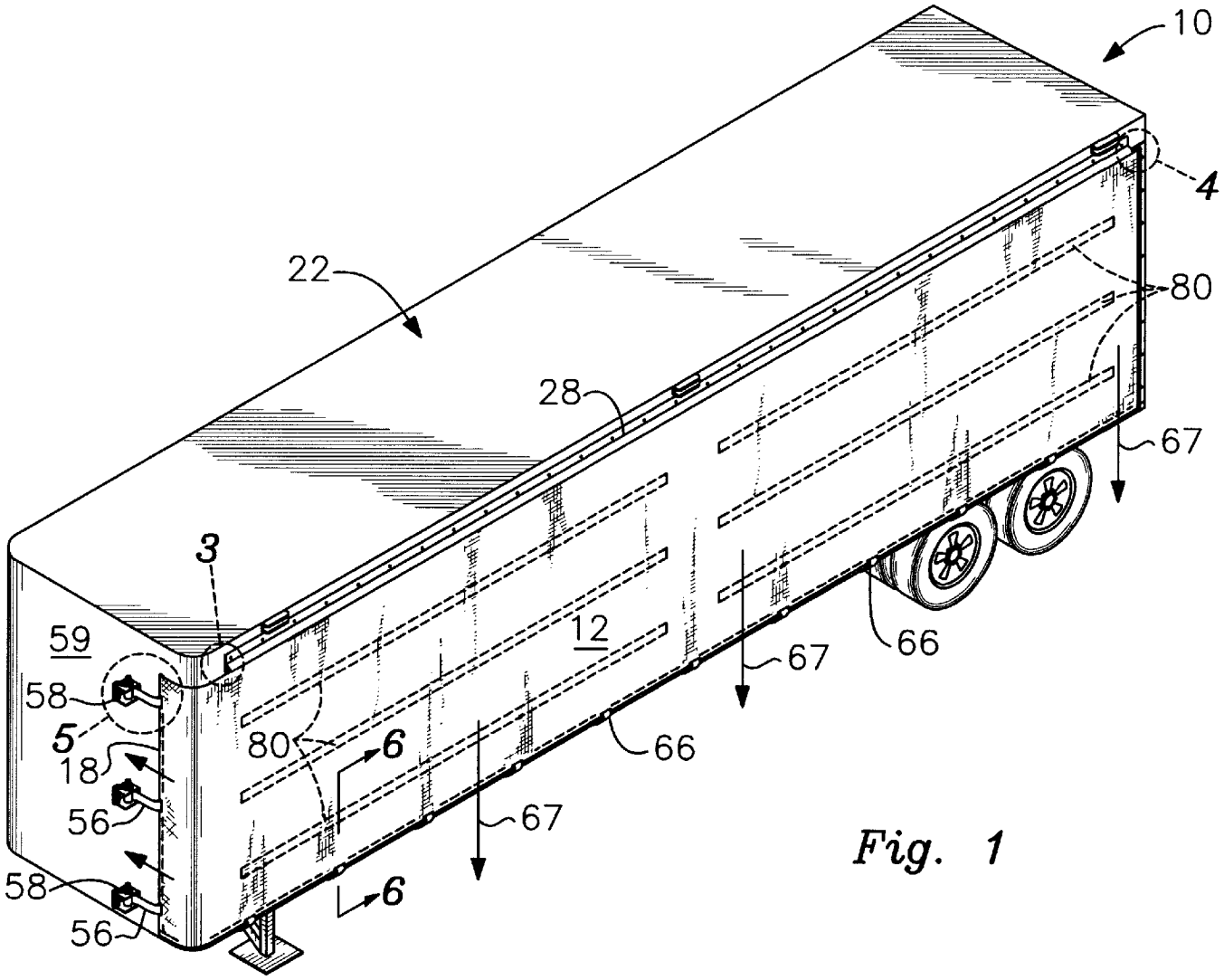
FIG. 1 is a perspective view of a truck trailer equipped with an illustrative embodiment of the invention.
Figure 2:
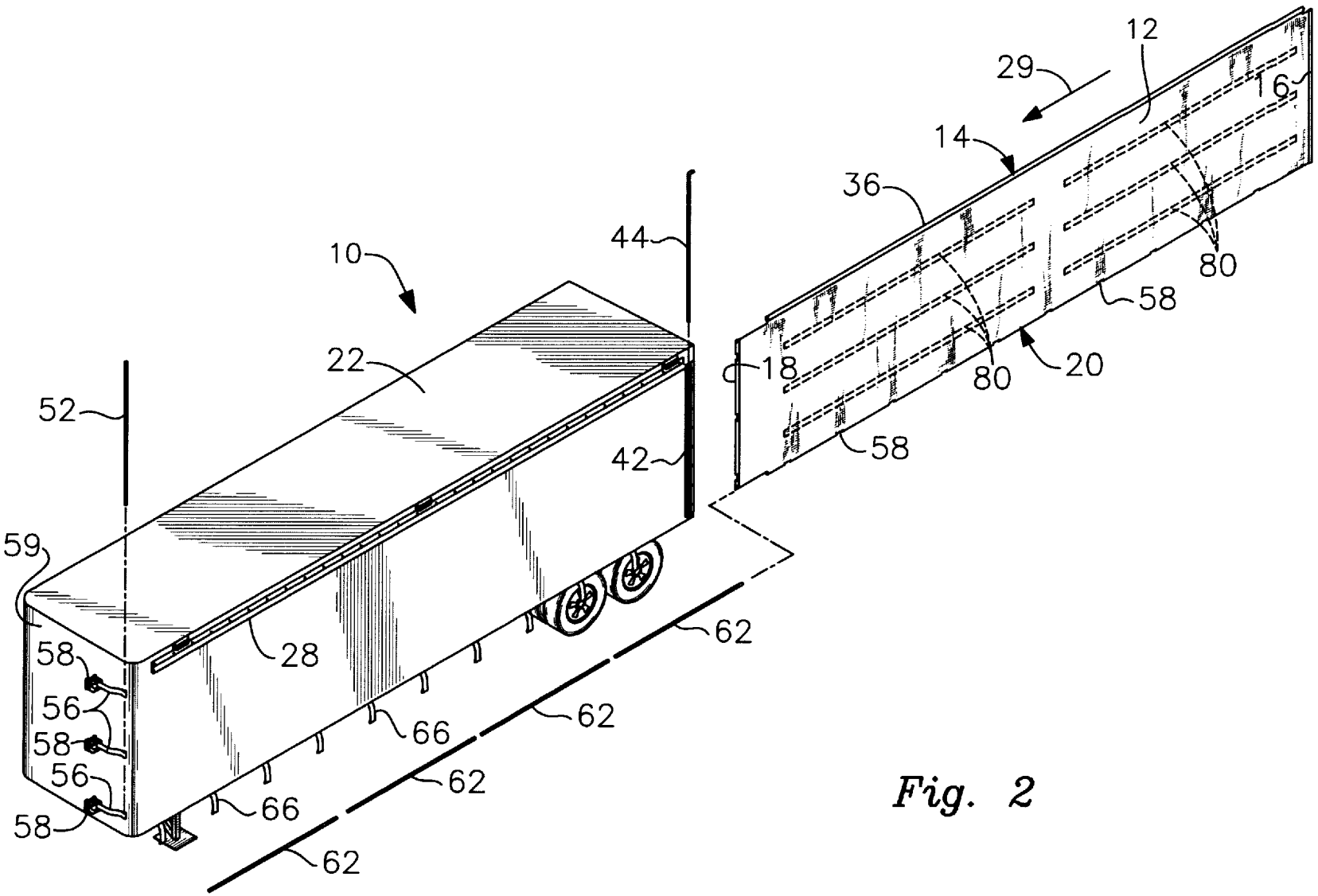
FIG. 2 is an exploded perspective view of the parts depicted in FIG. 1.

Referring now to FIGS. 1 and 2, it will there be seen that an exemplary embodiment of the invention is denoted as a whole by the reference numeral 10.

Substrate 12 is made of a suitable flexible material such as the same material commonly used as a substrate on conventional roadside billboards, i.e., a reinforced vinyl fabric. Other suitable materials are within the scope of this invention.

Substrate 12 is of rectangular shape to correspond to the shape of a truck side wall, a billboard, or other suitable advertising platform. As best understood in connection with FIG. 2, substrate 12 includes longitudinally extending upper edge 14, vertically extending rearward edge 16, vertically extending forward edge 18, and longitudinally extending lower edge 20.

Figure 3:
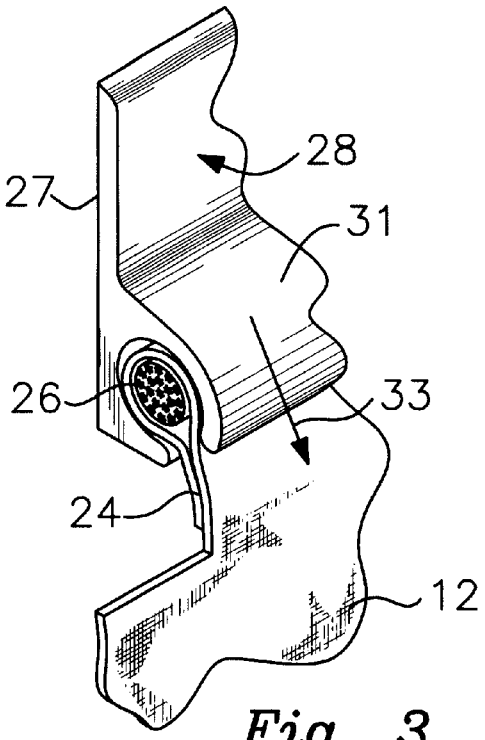
FIG. 3 is a detailed perspective view of the encircled parts in FIG. 1 denoted 3.
Figure 3A:
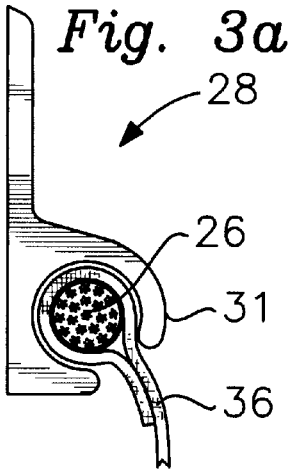
FIG. 3*a* is a side elevational view of the parts depicted in FIG. 3.
Figure 3B:
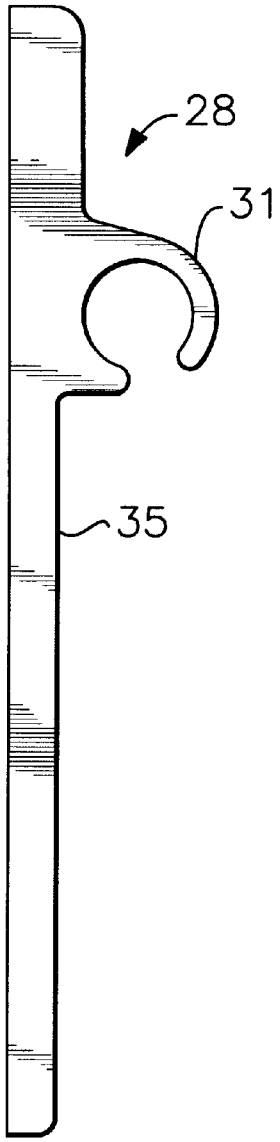
FIG. 3*b* is a side view of an alternative embodiment.

A first means for attaching longitudinally extending upper edge 14 of substrate 12 to the corresponding edge of trailer 22 is depicted in FIGS. 3, 3*a*, and 3*b*. The novel structure includes an upper hem 24 formed in substrate upper edge 14. The upper edge forms an elongate upper loop which receives elongate upper hem loop-occupying member 26 which may be provided in the form of a flexible elastomer, rope, rod, cylinder, flat bar, or other substantially noncompressible member. In the preferred embodiment of the invention, an elongate, solid, substantially noncompressible, flexible, rod-shaped member 26 of elastomeric construction is positioned within substrate upper hem 24 at the time said hem is sewn, sealed, or otherwise formed into the substrate, i.e., member 26 is placed into overlying relation to the substrate near the upper edge thereof, and the fabric is folded over said member and the hem is sewn or otherwise formed tightly around it so that it is snugly held.

A material formed of a suitable substrate material that includes a loop-forming hem having an elongate, flexible, substantially noncompressible elastomeric rod already positioned within the loop is also commercially available.

As indicated in FIG. 2, a rigid frame 28 is permanently attached to the truck along its longitudinally extending upper edge, and said substrate upper hem 24 and said elongate upper hem-occupying member 26 are slidingly introduced into and retained by said rigid frame 28, as indicated by directional arrow 29.

Note in FIG. 3 that flat base 27 of frame 28 is secured by suitable means to the trailer, and that housing part 31 thereof that slideably receives hem 24 and member 26 is made of a rigid material so that said hem and said substantially non-compressible loop-occupying member cannot be pulled therefrom in the direction of arrow 33.

In the alternate embodiment of FIG. 3*b*, rigid frame 28 is formed integrally with a truck structural frame 35 to eliminate the step of affixing frame 28 to said truck; it should be understood that the sidewalls of a truck are usually framed with a structural frame.

Figure 4:
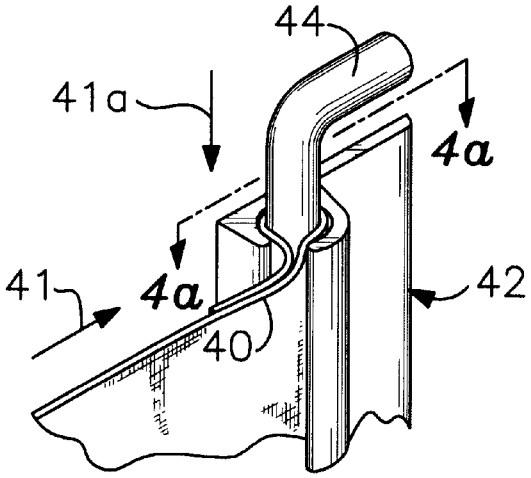
FIG. 4 is a detailed perspective view of the parts encircled in FIG. 1 and denoted 4.
Figure 4A:
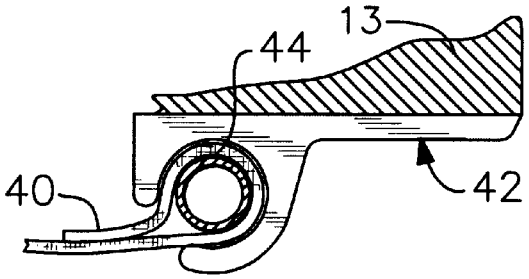
FIG. 4*a* is a view taken along line 4*a*—4*a* in FIG. 4.
Figure 4B:
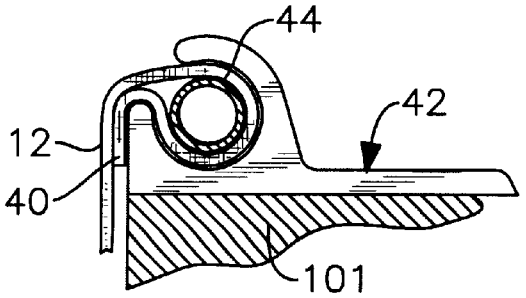
FIG. 4*b* depicts the parts of FIG. 4*a* when said parts are mounted on a rear wall of a truck having an overhead retractable rear door.

A first means for securing the rearward or trailing end 16 of substrate 12 is depicted in FIGS. 4 and 4*a*; it is similar to but different from the means for securing the upper edge thereof. The rearward attachment means includes a rearward hem 40, said rearward hem forming an elongate rearward loop in the vertically extending rearward edge of substrate 12. This rearward loop is inserted, in the manner indicated by directional arrow 41, into a rigid rearward frame 42, having a structure like rigid upper frame 28, that is attached to sidewall 13 (FIG. 4*a*) of the truck trailer along its vertically extending rearward edge. As indicated in FIG. 4*b*, however, frame member 42 may also be mounted on the rear wall of the truck so that the substrate wraps around the vertically extending rear corner of the truck. Mounting frame 42 on said rear wall does not increase the effective width of the truck, but mounting it on the side wall of the truck (as in FIG. 4*a*) would increase said effective width by the width of said frame member 42. In either case, an elongate, rigid rearward hem loop-occupying member 44 is axially inserted into said elongate rearward loop, as indicated by directional arrow 41*a*. As depicted in FIGS. 2 and 4, the uppermost end of member 44 may be bent, beaded, or otherwise formed so that it engages the uppermost edge of frame 42 so that it is suspended thereby. Alternatively, the lowermost end of the rearward loop is sewn shut or otherwise closed to support member 44 from the bottom. Any suspended mounting of member 44 is preferred; the invention is not limited to the particular suspension means depicted. Note that this mounting cannot be used with trucks having hingedly mounted rear doors because the hinges would block member 44. Thus, this particular embodiment is directed to trucks having doors of the overhead retractable type.

More particularly, in trucks having no hingedly mounted rear doors, i.e., in trucks having overhead retractable rear doors, frame 42 is mounted on the rear wall 101 (FIG. 4*b*)

of the truck. If each side wall of the truck is provided with a substrate, then a frame 42 is mounted on opposite sides of the truck's rear wall. FIG. 4*b* shows frame 42 of FIG. 4*a* when mounted on a rear wall 101 of a truck.

It should be observed that upper rigid frame 28 and rearward rigid frame 42 are permanently mounted to a truck that will be used as an advertising platform. Thus, the above-mentioned steps of installing such rigid frames is not carried out each time an advertising message is changed.

Figure 5:
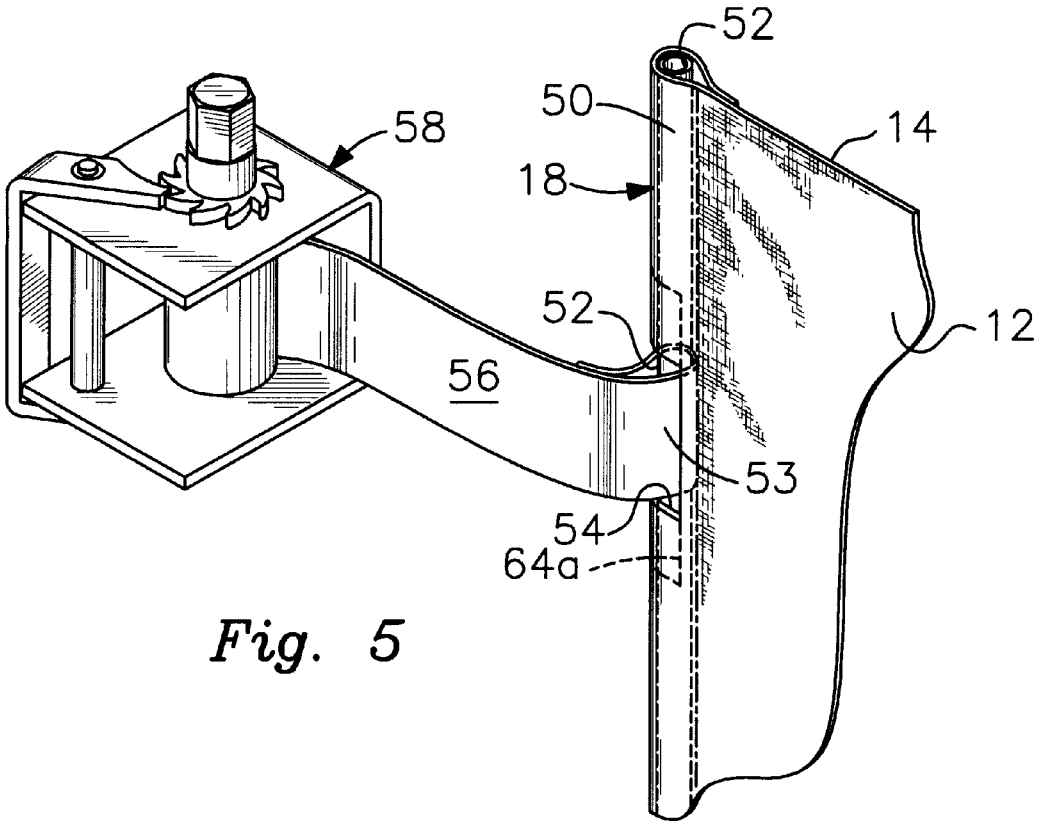
FIG. 5 is a perspective view of the parts encircled in FIG. 1 and denoted 5.

As best depicted in FIG. 5, an elongate forward hem 50 is formed in vertically extending forward edge 18; it forms an elongate forward loop that slideably receives therein an elongate forward hem loop-occupying member 52 which may take the form of a rigid rod, cylinder, pipe, flat strap, or the like.

At least one opening 54 is formed in elongate forward hem 50, and at least one substrate-tightening strap 56 having a first end disposed in engaging relation to elongate forward hem-occupying member 52 is in registration with said at least one opening. Preferably, each strap first end has a loop 53 formed therein for slideably receiving loop-occupying member 52. Where a plurality of straps are employed as in the depicted embodiment, member 52 is sequentially introduced into said strap loops as said member 52 is slideably and axially inserted into said loop defined by substrate forward hem 50.

At least one winch means 58 is mounted on transversely disposed forward wall 59 (FIG. 1) of truck 22, and said at least one substrate-tightening strap 56 has a second end engaged by said winch means 58. Accordingly, operation of winch means 58 in a first direction coils said at least one strap 56 about said winch means and thus pulls substrate 12 forwardly to inhibit flexing thereof in response to air movement thereacross. Operation of winch means 58 in a second direction opposite to the first direction loosens substrate 12 and facilitates removal of forward hem-occupying member 52 from elongate forward hem 50.

Each winch means 58 is best mounted on a structural member that underlies truck forward wall 59.

Figure 6:
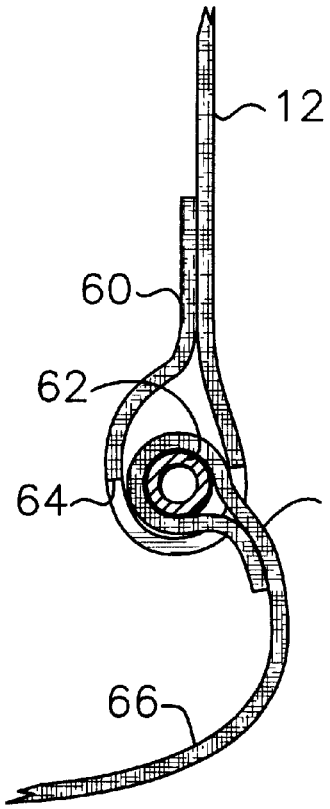
FIG. 6 is a sectional view taken along line 6—6 in FIG. 1.
Figure 7:
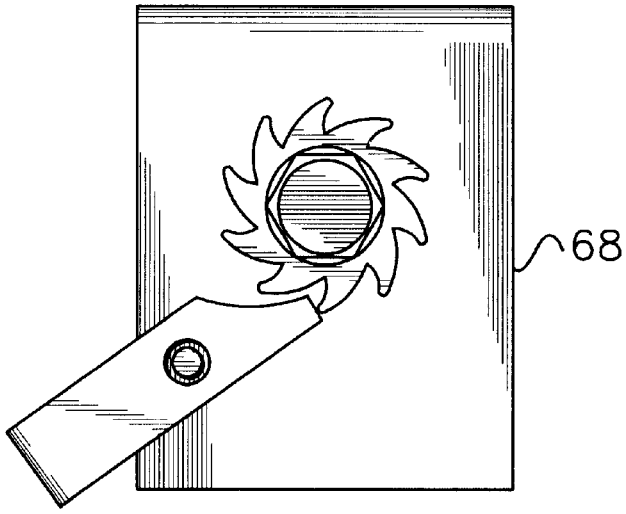
FIG. 7 is a side elevational view of a winch.
Figure 8:
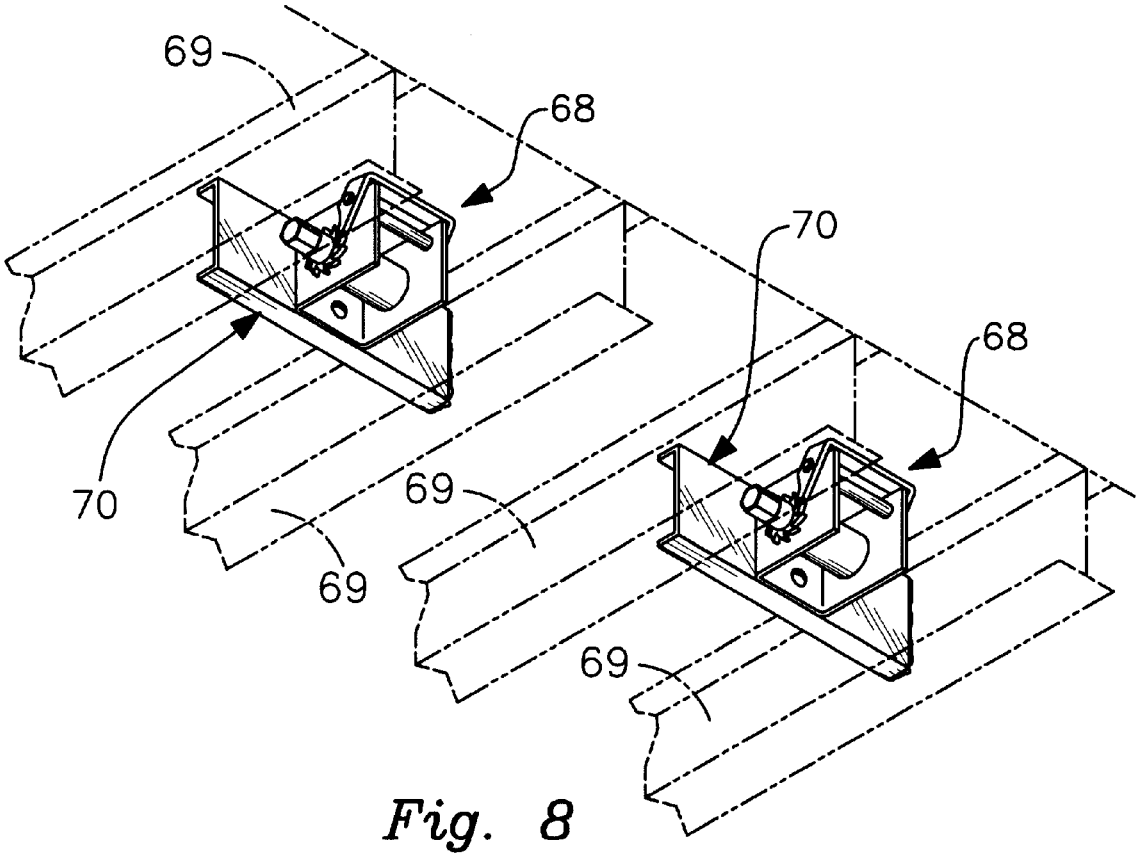
FIG. 8 is a perspective view of the underside of a truck trailer equipped with winches.

The lower attachment means is substantially similar to the forward attachment means. As indicated in FIG. 6, it includes an elongate lower hem 60 forming an elongate lower loop in longitudinally extending lower edge 20 of substrate 12; an elongate lower hem loop-occupying member 62, which may be provided in multiple sections as indicated in FIG. 1, is slideably received within said elongate lower loop. At least one opening 64 is formed in elongate lower hem 60 and at least one substrate-tightening strap 66 having a first end 67 disposed in engaging relation to said elongate lower hem-occupying member 62 is in registration with said at least one opening 64. At least one winch means 68 (FIG. 7), operated by a ratchet and pawl mechanism, is mounted to an underside of the truck. More particularly, as depicted in FIG. 8, winches 68 are secured to channels 70 having their opposite ends secured to I-beams 69 which form a structural part of the truck's underside. Said at least one substrate-tightening strap 66 has a second end engaged by said at least one winch means. Accordingly, operation of said at least one winch means in a first direction coils said at least one strap about said at least one winch means and thus pulls substrate 12 downwardly as at 67 (FIG. 1) to inhibit flexing thereof in response to air movement thereacross. Operation of said at least one winch means in a second direction opposite to said first direction loosens the substrate and facilitates removal of lower hem-occupying member 62 from elongate lower hem 60.

Note that strap openings 64*a*, indicated in broken lines in FIG. 5, (in connection with winches 58) may be of greater longitudinal extent than the straps which they receive to facilitate alignment of the winches and their associated straps.

The length of straps 66 is adjustable so that substrate 12 extends over the longitudinally extending lower edge of the truck or so that just the straps themselves extend over said edge as depicted in FIG. 1. In the former configuration, the substrate would wrap under the trailer in the same way it wraps around the leading end of the trailer as depicted in FIG. 1.

In the attachment means for both the forward and lower edges of substrate 12, there are preferably a plurality of equidistantly spaced apart slots and winches as depicted in the Figures.

In a second embodiment, also depicted in FIGS. 1 and 2, one or more elongate strengthening members, collectively denoted 80, are mounted to the underside of substrate 12. More particularly, said members 80 are slideably received within pockets defined by suitable means on said reverse side of the substrate; accordingly, they resist flapping of the substrate in the same manner that battens prevent flapping of sails in sailboats.

In one embodiment of the invention, rigid frames 28 and 42 are preferably permanently mounted to the upper and rearward edges of the sidewall of the trailer, respectively, as mentioned earlier. In another embodiment, also already mentioned, frame 42 is permanently mounted to the rear wall of a truck of the type having overhead retractable doors. In either embodiment, said frames 28 and 42 will not be noticed by casual observers of the trailer when no advertising-carrying substrate is installed thereon. Similarly, winches 58 and 68 for tightening the forward and lower edges of the substrate, respectively, are also permanently mounted on the trailer; those winches on the underside of the truck are substantially hidden from view.

Figure 9A:
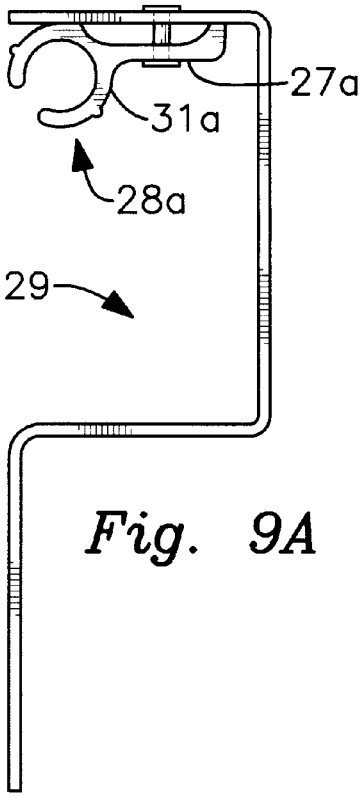
FIG. 9*a* is a view similar to the view of FIG. 3*a*, but depicting a frame like that depicted in FIGS. 3 and 3*a* positioned within a longituuinally-extending recess formed in the truck side wall at the upper end thereof.
Figure 9B:
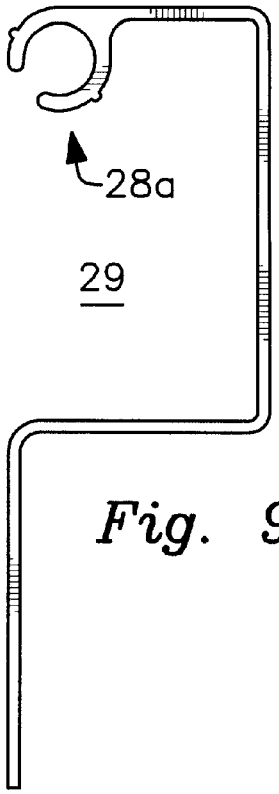
FIG. 9*b* is a view similar to that of FIG. 9*a*, but depicting an embodiment where the frame is integrally formed with the recess.
Figure 9C:
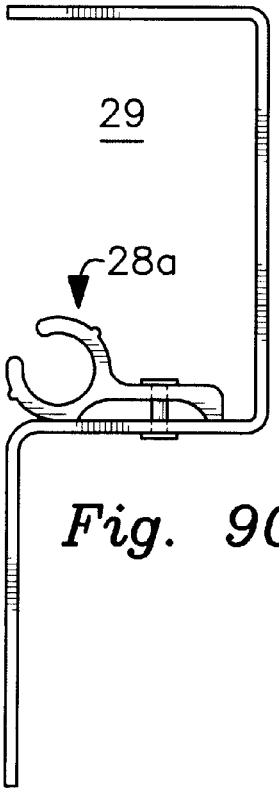
FIG. 9*c* is a view similar to the view of FIG. 3*a*, but depicting the frame of FIG. 3 and FIG. 3*a* positioned within a longitudinally-extending recess formed in the truck side wall at the lower end thereof.
Figure 9D:
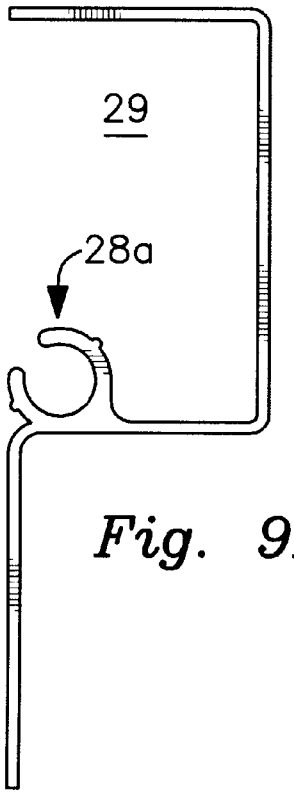
FIG. 9*d* is a view similar to that of FIG. 9*c*, but depicting an embodiment where the frame is integrally formed with the recess.

As best understood in connection with FIGS. 9*a*–9*d*, a longitudinally-extending recess 29 is formed in many truck side walls near the uppermost edge thereof. Advantageously, recess 29, which is provided by the truck manufacturer to strengthen the side wall, may be employed to accommodate frame 28*a* (see FIGS. 3 and 3*a*) as depicted in FIGS. 9*a* and 9*c*, so that frame 28*a* does not increase the effective width of the truck. The width of frame back wall 27*a* cannot exceed the depth of the recess. Alternatively, as depicted in FIGS. 9*b* and 9*d*, frame 28*a* may be provided at the time of truck manufacture, i.e., it may be built into the recess as an integral part thereof; this eliminates the step of attaching a separate frame 28*a* to the truck.

To avoid increasing the effective width of the truck when using the side-mounted hardware of FIGS. 4 and 4*a*, it is necessary to position such hardware on the rear wall of the truck as depicted in FIG. 4*b*. Such repositioning is possible with a truck having an overhead door that retracts upwardly into the truck, like a garage door, but such repositioning is not possible in the environment of a truck having a pair of opposed, hingedly mounted doors for the reason mentioned earlier.

Figure 10:
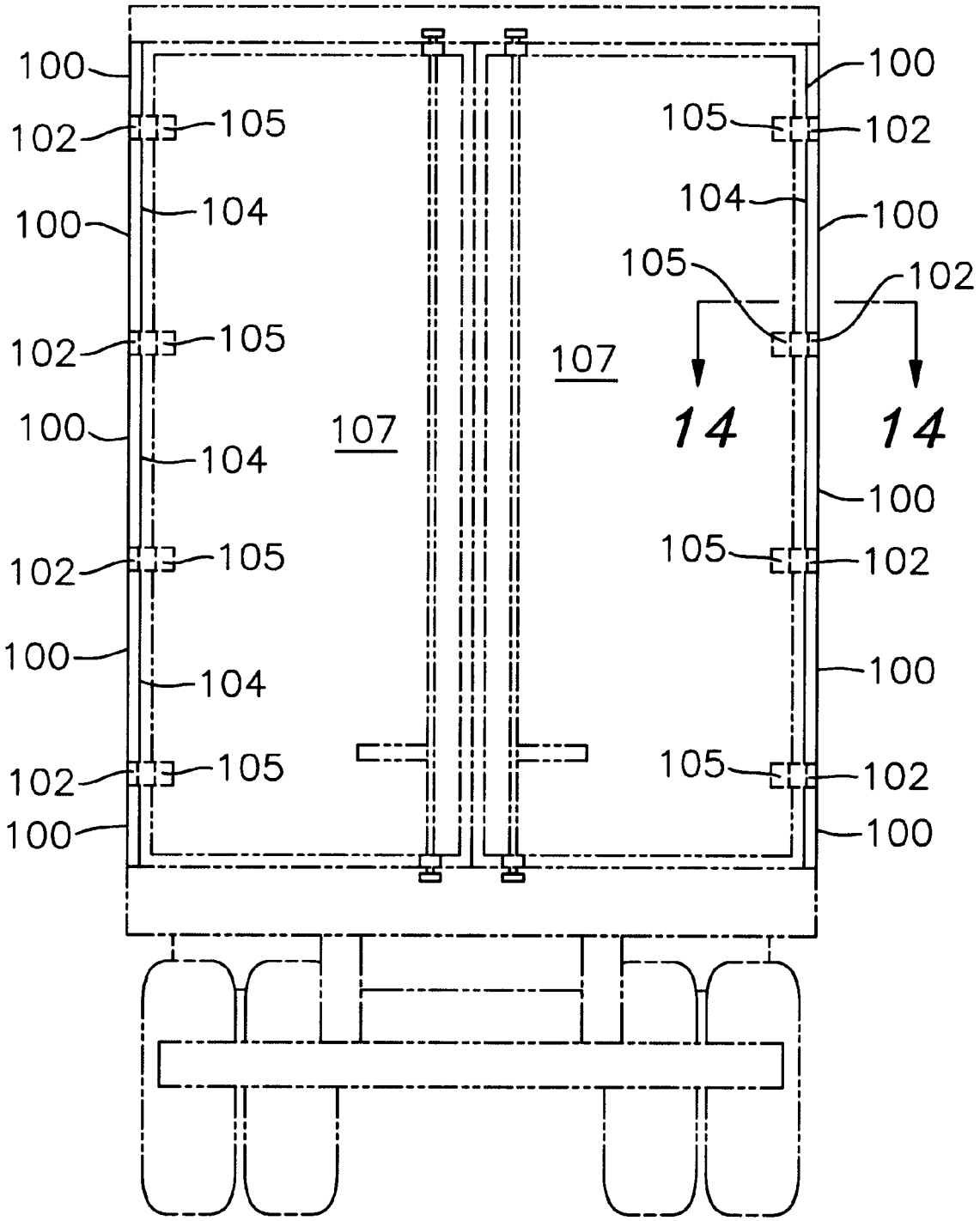
FIG. 10 is a rear elevational view of a truck having hingedly mounted rear doors, depicting the positioning of the novel anchor strips on vertical rear wall posts of the truck.

FIG. 10 provides a rear view of a truck having a pair of hingedly mounted, opposed doors. A plurality of elongate, novel anchor strips 100 are positioned above, below, and between hinge bases or butts 102 so as not to interfere with their operation. More particularly, each anchor strip 100 is permanently mounted by suitable means to a vertical trailer rear wall post 104 which frames the rear wall 101 of the truck. Hinge butts 102 are similarly mounted to the same posts, it being understood that the flaps 105 of each hinge are secured to their respective doors 107.

Figure 13:
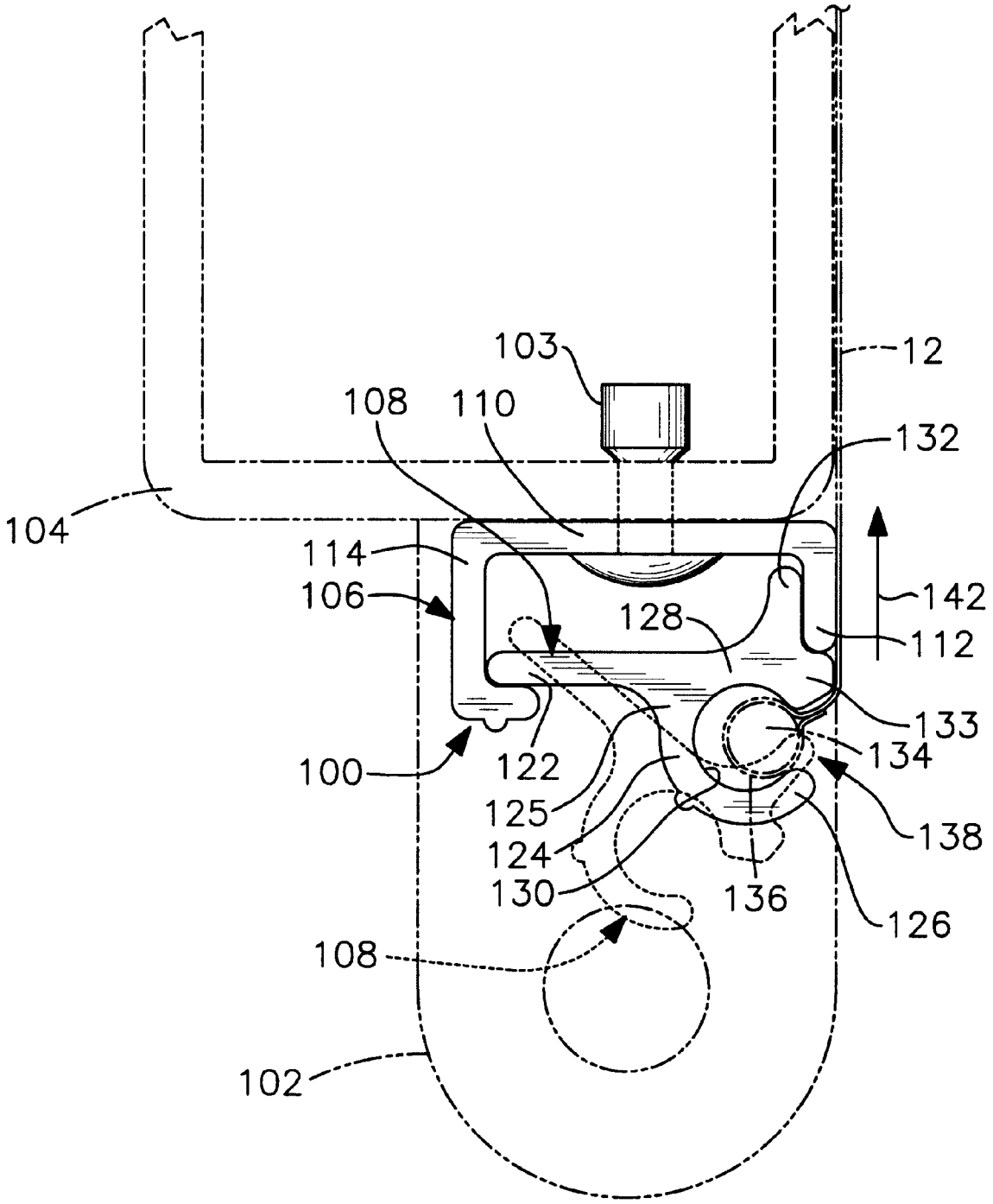
FIG. 13 is a top plan view of the first and second parts of the novel anchor strip when functionally mounted on a vertical rear wall post of a truck.

It should be clear that anchor strips 100 and hinge butts 102 extend longitudinally from the upstanding rear posts 104 of the truck, thereby having no effect on the width of the truck. As depicted in FIG. 13, the longitudinal extent of novel anchor strips 100 is less than the longitudinal extent of the door hinge butts 102.

Figure 11:
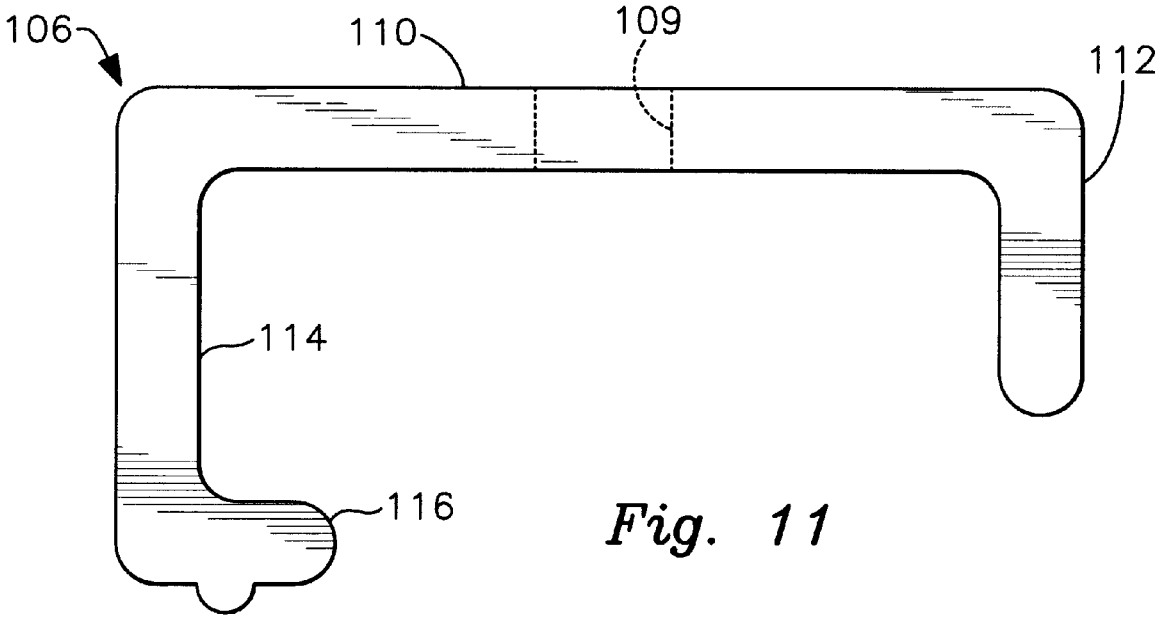
FIG. 11 is a plan view of a first part of the novel anchor strip.
Figure 12:
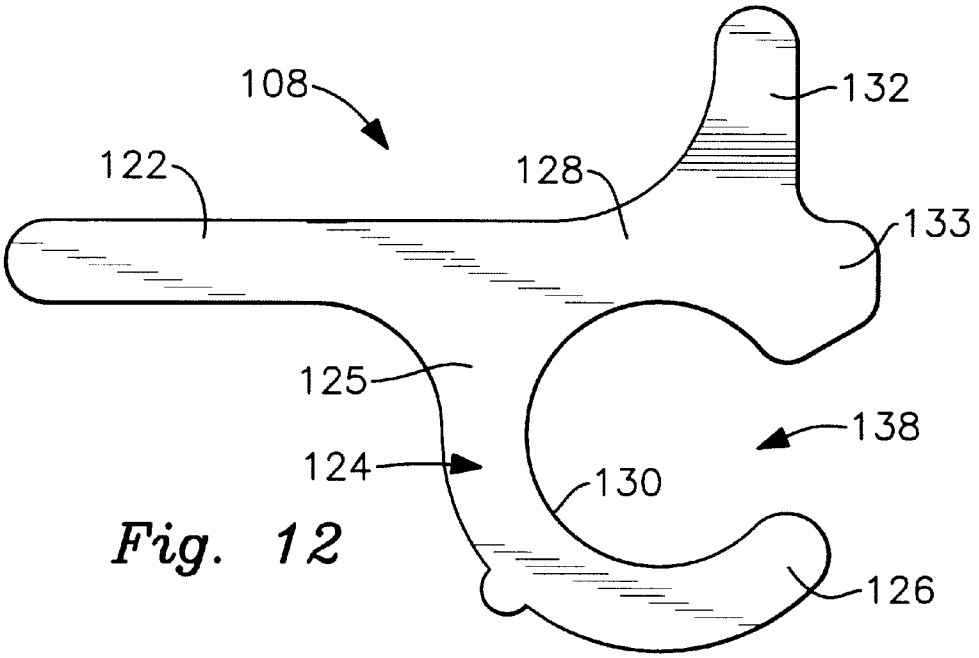
FIG. 12 is a plan view of a second part of the novel anchor strip.

The novel stucture of anchor strips 100 is more fully disclosed in FIGS. 11–13. It should be understood that each anchor strip 100 is made of a first part 106, depicted in FIG. 11, a second part 108, depicted in FIG. 12, and that said first and second parts are interlocked to one another when in use in the manner depicted in FIG. 13.

It should also be appreciated that strips 100 may be made in any length so as to fit above, below, and between the door hinge butts of any particular truck.

First part 106 has a flat base 110 that abuts post 104; said base is bored as at 109 to receive a rivet or screw 103 (FIG. 13) that is secured to said post 104 to secure said first part 106 thereto. Any other suitable means for permanently securing first part 106 to post 104 is within the scope of this invention.

First part 106 further includes a longitudinally-extending truncate outer wall 112 that is substantially flush with a side wall of the truck when the novel anchor strips are properly mounted, a longitudinally-extending inner wall 114 having a longitudinal extent greater than that of truncate wall 112, and a transversely disposed capture wall 116. Outer wall 112 and inner wall 114 are parallel to one another.

Second part 108 (FIG. 12) includes a straight leading arm 122, a semicircular part 124 having a proximal part 125 integral with said leading arm and a free end 126. A base 128 has a semicircular recess formed therein that collectively with semicircular part 124 defines a circular opening 130. A longitudinally-extending lip 132 and an outermost part 133 complete the structure of second part 108. A predetermined amount of space 138 is provided between free end 126 and outermost part 133 to provide an access opening into cavity 130.

A substantially noncompressible, flexible member of elastomeric construction 134 (FIG. 13) or other suitable hem-occupying (or hem-expanding) member is pre-positioned within a vertically-extending hem 136 formed in the vertically extending trailing edge of substrate 12, and said trailing edge of said substrate is axially inserted into cavity 130 when a new advertising message is being attached to the truck, as more fully set forth below.

As best understood in connection with FIG. 13, first part 106 is riveted or otherwise permanently secured to post 104. As indicated by the phantom lines in said FIG. 13, second part 108 is engaged to first part 106 by rotating said second part into its solid line position. More particularly, leading arm 122 of second part 108 is first inserted, with hem 136 and hem-occupying member 134 already having been axially received into cavity 130, (substrate 12 having not yet been tightened) behind capture wall 116 of first part 106. Second part 108 is then rotated into its solid line position where lip 132 abuts truncate outer wall 112 of first part 106 and outermost part 133 abuts the free end of said truncate outer wall as indicated in solid lines in said FIG. 13. Thus, as substrate 12 pulls on hem-occupying member 134 in the direction indicated by directional arrow 142, capture wall 116 holds leading arm 122 of part 108 against rotational movement so that the substrate can be fully tightened.

Since each anchor strip 100 is positioned in non-interfering relation to each hinge butt 102, the door hinges operate as if the novel anchor strips were not installed. Substrate 12 and parts 106, 108 are cut as needed to accommodate each hinge butt as indicated in FIG. 10. A similar cutting of substrate 12 may be seen in FIG. 3.

Like all of the other substrate-engaging parts of this invention, first parts 106 are left in place at all times. It is a simple matter to change signs by simply releasing tension on the substrate at its forward end (by loosening the pull of the winches), remove part 108 from part 106, and axially separating part 108 from the trailing edge of the substrate.

Since both parts 106, 108 of anchor strips 100 are extruded, they are inexpensive. When used in conjunction with the recessed placement of frame 28, this embodiment of the invention provides the first substrate-mounting apparatus that does not increase the effective width of the vehicle to which it is attached. It follows that vehicles equipped with the novel anchor strips will not be in violation of vehicular width limitation laws.

Figure 14:
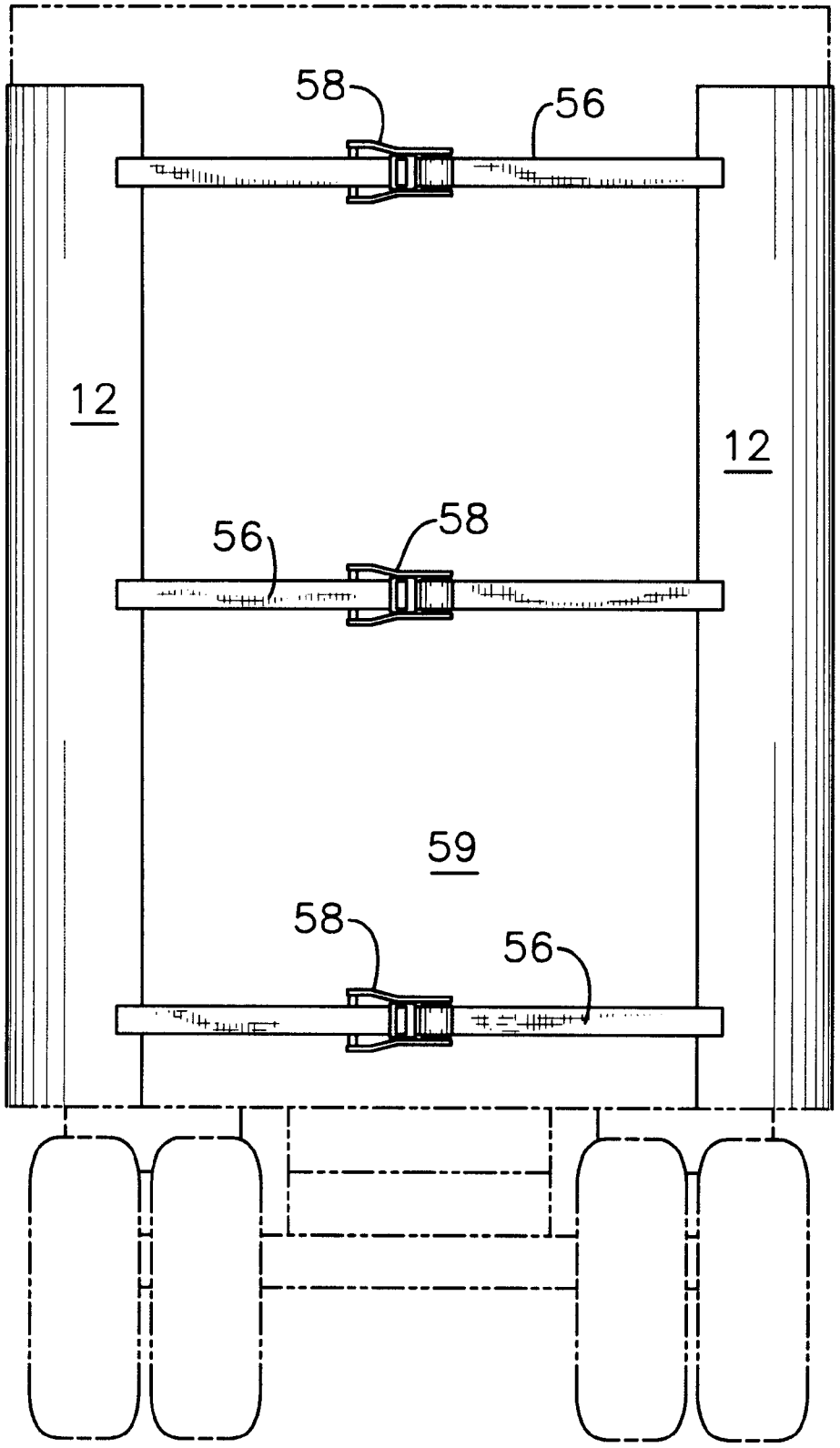
FIG. 14 is a front elevational view of a truck showing winches that engage respective forward edges of substrates positioned on opposite side walls of the truck.
Figure 15:
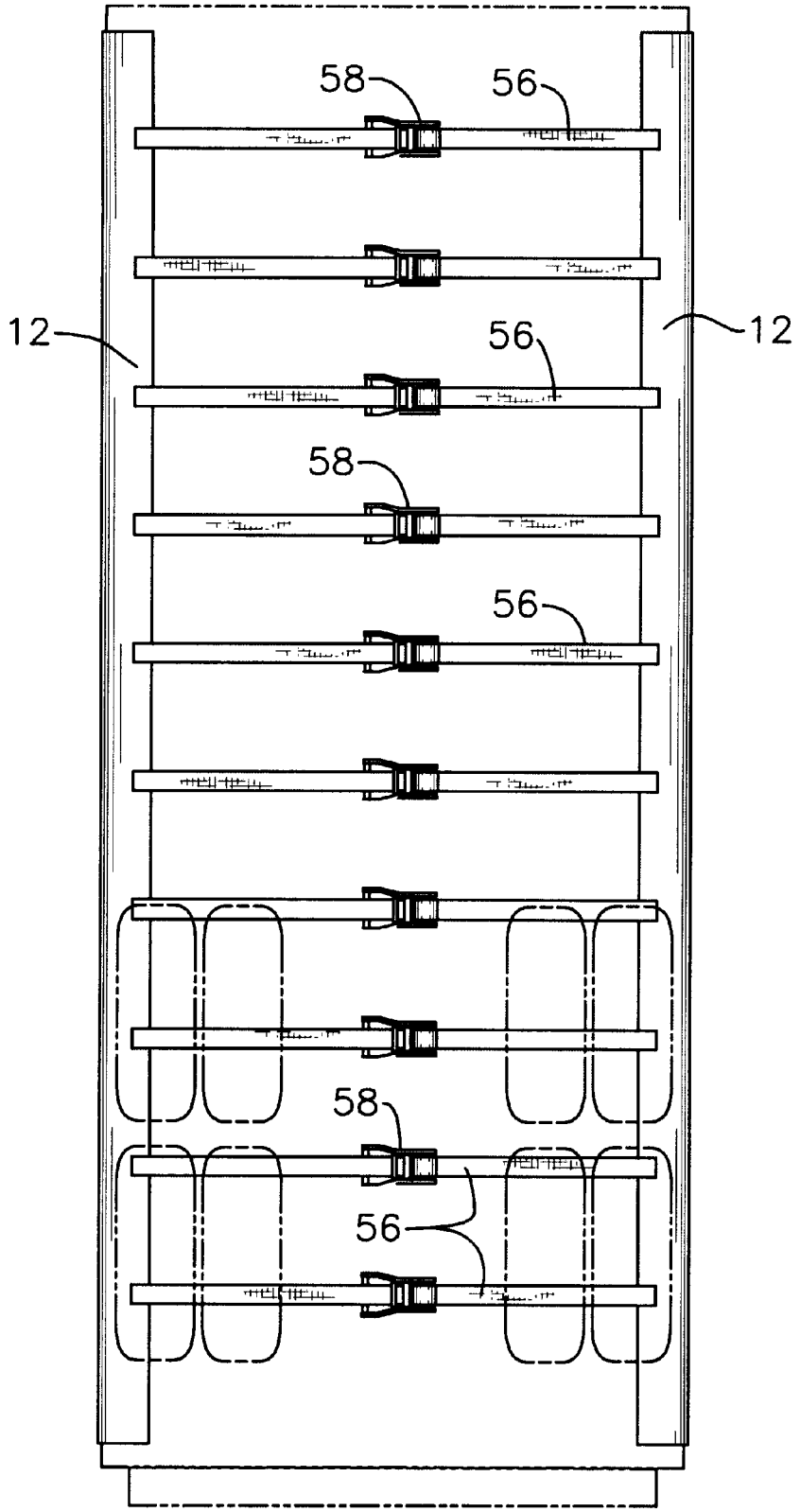
FIG. 15 is a bottom plan view of a truck showing winches that engage respective longitudinally extending lower edges of substrates positioned on opposite side walls of the truck.

Still further improvements are depicted in FIGS. 14 and 15. Both figures depict a truck having both of its side walls covered by a substrate.

Winches 58 (FIG. 14) are positioned in overlying relation to front wall 59 of the truck, but they need not be bolted thereto; such bolting is necessary in the embodiment of FIG. 1. Straps 56 are flatbed winch straps and the winches are of the ratchet type; the winches and straps are commercially available from sources such as Certified Slings, Inc. of Casselberry, Fla., and are commercially known as cargo tiedowns. The end fittings of the winch straps are provided in many forms, including sewn loops, grab hooks, snap hooks, and the like. When tightened, the straps support the weight of the winches and thus there is no need to bolt the winches to the front wall as aforesaid.

FIG. 15 depicts a similar arrangement for interconnecting opposing substrates at the underside of a truck. Thus, there is no need to bolt winches 68 to cross frames 70 as depicted in FIGS. 8. The tension of the straps holds the winches and thus there is no need to fasten the winches to structural parts of the truck underside.

The use of cargo tiedowns in this manner halves the number of winches that would otherwise be required to attach substrates to opposite side walls of a truck, and obviates any need to drill holes in the truck since the winches are supported by the straps.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An apparatus in combination with a flexible substrate, said apparatus adapted to attach said flexible substrate to a side wall of a truck, said side wall of a type having a longitudinally extending recess formed therein along an uppermost edge thereof, comprising:

said flexible substrate having a predetermined longitudinal and vertical extent;

said flexible substrate having a longitudinally extending upper edge, a longitudinally extending lower edge, a vertically extending forward edge, and a vertically extending rearward edge;

upper attachment means adapted for mounting in said longitudinally extending recess for releasably positioning said longitudinally extending upper edge of said substrate within said recess, rearward attachment means adapted for mounting on a transversely disposed rear wall of said truck for releasably attaching said vertically extending rearward edge of said substrate to said transversely disposed rear wall, said flexible substrate adapted to bend around a vertically disposed rearward edge of said truck;

forward attachment means adapted for mounting on a transversely disposed front wall of said truck for releasably attaching said vertically extending forward edge of said substrate to said transversely disposed front wall, said flexible substrate adapted to bend around a vertically disposed forward edge of said truck to prevent air from flowing in a space between said substrate and said side of said truck;

lower attachment means adapted for mounting on an underside of said truck for releasably attaching said longitudinally extending lower edge of said substrate to said underside, said flexible substrate adapted to bend around a longitudinally extending lower edge of said truck;

said transversely disposed rear wall of said truck including a pair of opposed, hingedly mounted doors;

a vertically extending post intended for being positioned adjacent each hingedly mounted door on an outboard side thereof;

a plurality of hinge butts being secured to both of said posts in vertically spaced relation to one another;

an elongate rearward hem formed in said vertically extending rearward edge of said substrate;

said elongate rearward hem forming an elongate rearward loop in said vertically extending rearward edge of said substrate;

an elongate rearward hem loop-occupying member disposed in said elongate rearward loop;

a plurality of anchor strips adapted to be attached to each of said posts between said hinge butts in non-interfering relation to said hinge butts;

said elongate rearward hem and said elongate rearward hem-occupying member being received within and detained by said plurality of anchor strips;

each anchor strip of said plurality of anchor strips including a first part that is fixedly secured to a post and a second part that is releasably interconnectable to said first part;

said second part being adapted to receive and retain said vertically extending rearward hem of said substrate and said rearward hem-occupying member;

said first part including a flat base that abuts said post and means for permanently securing said flat base to said post;

said first part further including a truncate outer arm that is integrally formed with an outer end of said flat base, said truncate outer arm adapted to be positioned substantially flush with said side wall of said truck;

said first part further including an inner arm that is integrally formed with an inner end of said flat base, said inner arm being parallel to said truncate outer arm and having a longitudinal extent greater than a longitudinal extent of said outer arm; and a transversely disposed capture arm integrally formed with a free end of said inner arm.

2. The apparatus of claim 1, wherein said upper attachment means comprises:

an upper hem formed in said longitudinally extending upper edge of said substrate;

said upper hem forming an elongate upper loop in said longitudinally extending upper edge of said substrate;

an elongate upper hem loop-occupying member disposed in said elongate upper loop;

a rigid frame adapted to be disposed along said longitudinally extending upper edge of said truck;

said rigid frame adapted to be positioned in said longitudinally extending recess formed in said side wall;

said rigid frame adapted to have a width less than a depth of said recess;

said upper hem and said elongate upper hem-occupying member being received within and detained by said rigid frame.

3. The apparatus of claim 2, wherein said rigid frame is an extruded member that is adapted to be fixedly secured within said recess along an upper wall thereof.

4. The apparatus of claim 2, wherein said rigid frame is an extruded member that is adapted to be formed integrally with an upper wall of said recess.

5. The apparatus of claim 1, wherein said second part further comprises:

a straight leading arm;

a semicircular part having a proximal end integrally formed with said straight leading arm and having a free end;

a base having a semicircular recess formed therein;

a cavity defined collectively by said semicircular part and said semicircular recess;

said cavity having an opening defined by a predetermined amount of spacing between said free end of said semicircular part and an outermost end of said base; and a longitudinally-extending lip formed integrally with said base;

whereby said straight leading arm of said second part abuts said capture arm of said first part and is held against rotational movement by said capture arm when said first and second parts are interlocked to one another;

whereby said longitudinally-extending lip of said second part abuts said truncate arm of said first part when said first and second parts are interlocked to one another;

whereby said outermost part of said base abuts said free end of said truncate arm when said first and second parts are interlocked to one another;

whereby a hem having a hem-occupying member positioned therewithin is axially inserted into said cavity when said substrate is not under tension; and whereby said second part is placed into operable relation to said first part when said substrate is not under tension, said first and second parts being securely interlocked with one another when said substrate is placed under tension.

6. The apparatus of claim 1, wherein said forward attachment means comprises:

an elongate forward hem;

said elongate forward hem forming an elongate forward loop in said vertically extending forward edge of said substrate;

an elongate forward hem loop-occupying member disposed in said elongate forward hem loop;

at least one opening formed in said elongate forward hem;

at least one substrate-tightening strap having a first end disposed in engaging relation to said elongate forward hem-occupying member in registration with said at least one opening;

at least one winch means mounted on said transversely disposed forward wall of said truck;

said at least one substrate-tightening strap having a second end engaged by said winch means;

whereby operation of said winch means in a first direction coils said at least one strap about said winch means and thus pulls said substrate to inhibit flexing thereof in response to air movement thereacross, and whereby operation of said winch means in a second direction opposite to said first direction loosens said substrate and facilitates removal of said forward hem-occupying member from said elongate forward hem.

7. The apparatus of claim 6, further comprising a batten means positioned on said substrate to inhibit flapping of the substrate when it is subjected to airflow caused by travel of said truck at high speeds.

8. The apparatus of claim 1, wherein said forward attachment means includes at least one winch means adapted to be mounted on said transversely disposed forward wall of said truck.

* * * * *